US009255733B2

(12) United States Patent
Bagwell et al.

(10) Patent No.: US 9,255,733 B2
(45) Date of Patent: Feb. 9, 2016

(54) OVEN FOR FIBER HEAT TREATMENT

(71) Applicants: Renee M. Bagwell, Niagara Falls, NY (US); William J. Stry, Orchard Park, NY (US)

(72) Inventors: Renee M. Bagwell, Niagara Falls, NY (US); William J. Stry, Orchard Park, NY (US)

(73) Assignee: Harper International Corporation, Lancaster, NY (US)

( * ) Notice: Subject to any disclaimer, the term of this patent is extended or adjusted under 35 U.S.C. 154(b) by 362 days.

(21) Appl. No.: 13/725,052

(22) Filed: Dec. 21, 2012

(65) Prior Publication Data

US 2013/0167397 A1 Jul. 4, 2013

Related U.S. Application Data

(60) Provisional application No. 61/580,953, filed on Dec. 28, 2011.

(51) Int. Cl.

| | |
|---|---|
| ***F27B 9/28*** | (2006.01) |
| ***F26B 3/04*** | (2006.01) |
| ***F26B 21/02*** | (2006.01) |
| *F26B 13/00* | (2006.01) |
| *F26B 25/12* | (2006.01) |

(52) U.S. Cl.

CPC ..... *F26B 3/04* (2013.01); *F26B 13/001* (2013.01); *F26B 21/02* (2013.01); *F26B 13/00* (2013.01); *F26B 25/12* (2013.01)

(58) Field of Classification Search

CPC ..... C21D 9/56; F27B 9/28; F27B 9/36; F27B 9/10

USPC ..... 122/8, 59, 121, 152; 264/173.14, 264/173.15; 432/8, 59, 121, 152

See application file for complete search history.

(56) References Cited

U.S. PATENT DOCUMENTS

| | | | | |
|---|---|---|---|---|
| 3,110,169 | A | 11/1963 | Suggs | |
| 4,094,627 | A | 6/1978 | Milton, Jr. | |
| 4,515,561 | A | 5/1985 | Melgaard | |
| 4,518,352 | A | 5/1985 | Gillhaus et al. | |
| 4,814,145 | A * | 3/1989 | Yoshida et al. | 422/150 |

(Continued)

FOREIGN PATENT DOCUMENTS

| | | |
|---|---|---|
| JP | 11-173761 | 7/1999 |

OTHER PUBLICATIONS

The International Search Report (ISR) and Written Opinion of the searching authority for PCT Application Serial No. PCT/US2012/071317; Publication No. WO 2013/101746 A3; dated Apr. 16, 2013.

(Continued)

*Primary Examiner* — Gregory A Wilson

(74) *Attorney, Agent, or Firm* — Phillips Lytle LLP

(57) ABSTRACT

An improved oven (1) comprising a conveyor configured and arranged to move a product (11) to be processed through an oven, a primary air delivery system (45) configured and arranged to provide a heated primary air flow (47), a secondary air delivery system configured and arranged to provide a heated secondary air flow (48), a processing enclosure (21) configured and arranged to receive and contain the product and the primary air flow, an insulated enclosure (2) configured and arranged to receive the heated secondary air flow, the processing enclosure configured and arranged to extend through the insulated enclosure and the heated secondary air flow and to separate the primary air flow from the secondary air flow.

32 Claims, 5 Drawing Sheets

(56) References Cited

U.S. PATENT DOCUMENTS

| | | | | |
|---|---|---|---|---|
| 4,921,686 | A * | 5/1990 | Yoshida et al. | 423/447.6 |
| 6,027,337 | A * | 2/2000 | Rogers et al. | 432/64 |
| 6,776,611 | B1 * | 8/2004 | Sprague | 432/64 |
| 2009/0220905 | A1 * | 9/2009 | McGowan | 432/8 |
| 2010/0119985 | A1 * | 5/2010 | Potterill et al. | 432/8 |
| 2013/0059261 | A1 * | 3/2013 | Sprague | 432/64 |

OTHER PUBLICATIONS

The (IB/373) International Preliminary Report on Patentability Chapter I for PCT Application Serial No. PCT/US2012/071317; Publication No. WO 2013/101746 A3; dated Apr. 16, 2013.

* cited by examiner

OVEN FOR FIBER HEAT TREATMENT

TECHNICAL FIELD

The present invention relates generally to the field of ovens and dryers, and more particularly to an improved oven for processing fiber bundles or tows.

BACKGROUND

Convection ovens and dryers that process continuous streams of product are in wide use. In many ovens the product moves horizontally at one or more levels, either carried on parallel moving conveyors or, in the case of textiles or webs, suspended under tension between external drives. A circulating hot air flow is brought in contact with the product for heating or drying. A technically important class of ovens treats polymeric or organic carbon fiber precursors in air to provide thermoplastic properties prior to carbonization.

Ovens for providing oxidative heat treatment to carbon fiber precursor materials such as polyacrylonitrile (PAN) are known in the industry. U.S. Pat. No. 6,776,611 describes an oven in which the heating airflow is circulated around the PAN in tow format and contacts the fiber in a direction perpendicular to the direction of tow travel. U.S. Pat. No. 4,515,561 discloses an oven in which the heating airflow is circulated around the PAN in tow format and contacts the fiber in a direction parallel to the direction of tow travel.

BRIEF SUMMARY OF THE INVENTION

With parenthetical reference to corresponding parts, portions or surfaces of the disclosed embodiment, merely for the purposes of illustration and not by way of limitation, the present invention provides an improved oven (1) comprising a conveyor configured and arranged to move a product (11) to be processed through an oven, a primary air delivery system (45) configured and arranged to provide a heated primary air flow (47), a secondary air delivery system configured and arranged to provide a heated secondary air flow (48), a processing enclosure (21) configured and arranged to receive and contain the product and the primary air flow, an insulated enclosure (2) configured and arranged to receive the heated secondary air flow, the processing enclosure configured and arranged to extend through the insulated enclosure and the heated secondary air flow and to separate the primary air flow from the secondary air flow.

The conveyor may be configured to move the product through the processing enclosure in a first direction (49), with individual passes moving either forward or backward, the processing enclosure may have a longitudinal enclosure axis (50) substantially parallel to the first direction, the primary air flow (47) in the processing enclosure may be substantially parallel to the first direction and the secondary air flow (48) in the insulated enclosure proximal to the processing enclosure may be substantially perpendicular to the first direction.

The primary air delivery system may comprise an input chamber (10) configured and arranged to receive the primary air flow and the conveyed product and to output the primary air flow and the conveyed product to the processing enclosure. The conveyor may be configured and arranged to move the product through the processing enclosure in a first direction and the chamber may output the heated primary air flow and the conveyed product to the processing enclosure in the first direction. The input chamber may comprise an air input opening (38), a product input opening (39) different from the air input opening, an output opening (43) to the processing enclosure opposite the product input opening, and an airflow directional (37) configured and arranged to direct airflow from the air input opening to the output opening. The air input opening may be orientated substantially perpendicular to the output opening and the airflow directional may be configured and arranged to turn the airflow from a direction substantially perpendicular to the first direction to a direction substantially parallel to the first direction. The output opening may be larger in size than the product input opening. The chamber may further comprises a product input opening size adjustment mechanism, and the opening size adjustment mechanism may comprise a first plate (29) and a second plate (30), the first and second plates adjustable relative to each other so as to provide a variable gap (39) there between. A locking mechanism may be configured and arranged to adjustably lock the plates in a position relative to the chamber so as to vary the size of the product opening, and the locking mechanism may comprise locking screws (31).

The oven may further comprise an output chamber (18) configured and arranged to receive the product and the primary air flow from the enclosure and to exhaust the primary air flow and discharge the product. The output chamber may comprise an input opening (44) from the processing enclosure, a product discharge opening (41) opposite the input opening and an air exhaust opening (42) different from the product discharge opening. The air exhaust opening may be orientated substantially perpendicular to the input opening. The output chamber may further comprise a product input opening size adjustment mechanism, and the opening size adjustment mechanism may comprise a first plate and a second plate, the first and second plates adjustable relative to each other so as to provide a variable gap (41) there between. A locking mechanism may be configured and arranged to adjustably lock the plates in a position relative to the chamber so as to vary the size of the product discharge opening, and the locking mechanism may comprise locking screws.

The primary air delivery system may comprise one or more devices selected from a group consisting of a fan (3), a heater (4), a thermometer (6), a manifold (7), a valve (8), a flow meter (9) and a pipe (5). The primary air delivery system may comprise a single regenerative fan, a single in-line heater, a thermometer, a single manifold configured and arranged to split airflow into a plurality of downstream paths, each of the paths comprising a valve and a flow meter, wherein the primary air flow is generated and circulated through the heater, the manifold and the valve no more than once before being brought into contact with the product. The primary air delivery system may comprise a single regenerative fan, a manifold configured and arranged to split airflow into a plurality of downstream paths, each of the paths comprising a valve, a flow meter, an in-line heater and a thermometer, before being brought into contact with the product. The primary air delivery system may not re-circulate, in whole or in part, primary air flow exiting the processing enclosure.

The secondary air delivery system may comprise a fan (12), a heater (13), a thermometer (35), a recirculating inlet (26) for receiving used air from the insulated enclosure, an air exhaust outlet (16) having a flow control valve (17) for exhausting air from the insulated enclosure, and a make-up air inlet (14) having a flow control valve (15) for receiving make-up air, wherein the secondary air flow may comprise a mix of the used air and the make-up air. The make-up air flow and the exhaust air flow may be controlled by the valves (15, 17) to vary the amount of the make-up air and the used air in the secondary air flow. The secondary air delivery system may comprise a plug fan (12) with an axis perpendicular to the processing enclosure axis (50), located on an insulation enclosure wall approximately midway along a product travel dimension of the oven, the fan having an upstream inlet cone (26) for receiving air and a discharge plenum (32) that directs flow downwards, a heater (13) positioned downstream and near the fan discharge port, a thermometer (35) positioned downstream and near the heater, a set of directing vanes (28) positioned near the heater and near a floor of the insulated enclosure that turn the flow 90 degrees to flow adjacent to the floor of the insulated enclosure, a second set of vanes (23) that split the flow approximately in half and turn a first half portion of the flow 90 degrees to be aligned with the first direction and turn the second half portion of the flow 90 degrees to be opposite the first direction, a third set of vanes (24*a*) that turn the first portion of the flow 90 degrees to flow upwards in a direction perpendicular to the enclosure axis, a fourth set of vanes (24*b*) that turn the second portion of the flow 90 degrees to flow upwards in a direction perpendicular to the enclosure axis, a flow conditioning device (22) that spans a length of the oven and is wider than a widest dimension of the processing enclosure and through which the upward air flow passes before contacting the processing enclosure, an upper perforated plate (27) above the processing enclosure, and an air collection plenum (36) separating air that flows through the upper perforated plate and into the fan inlet cone from air that is discharged from the fan and flows through the heater, turning vanes, flow conditioner and over the processing enclosure. The flow conditioning device may comprise two perforated plates with a cellular structures located there between, and the cellular structure may be a honeycomb structure.

The primary air delivery system and the secondary air delivery system may be configured and arranged to deliver the primary air flow to the inside of the processing enclosure and to deliver the secondary air flow to the outside of the processing enclosure at a temperature range that is about the same.

The processing enclosure may have a length and a cross-sectional characteristic dimension and the length may be at least about fifty times the cross-sectional characteristic dimension. The processing enclosure may have a cross-sectional shape that is circular, square, rectangular, oval or elliptical.

The oven may comprise multiple processing enclosures configured and arranged to receive and contain the product and the primary air flow and extending through the insulated enclosure. The oven may further comprise multiple input chambers and output chambers communicating with the respective multiple processing enclosures.

DESCRIPTION OF THE PREFERRED EMBODIMENTS

Figure 1:
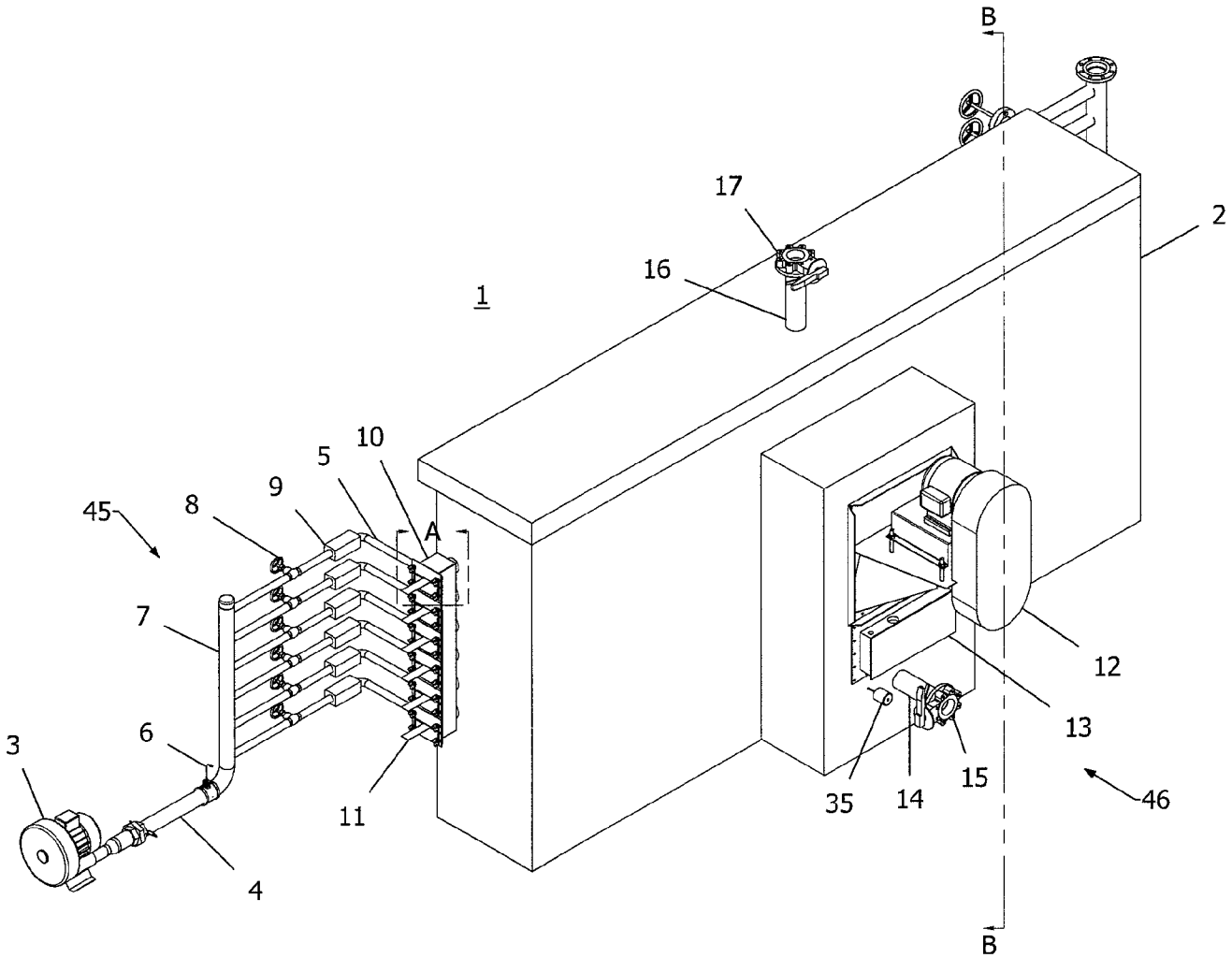
FIG. 1 is a perspective view of an oven in accordance with one embodiment of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring to the drawings, and more particularly to FIG. 1 thereof, this invention provides an improved oven for fiber heat treatment, of which a first embodiment is generally indicated at 1. While this invention has many applications for providing an efficient and high quality fiber heat treatment, it is described in this embodiment with regard to its application to an oxidative stabilization oven for carbon fiber precursor.

As shown in FIG. 1, oven 1 includes rectangular insulation enclosure 2, which is of conventional construction using structural and sheet steel and mineral or glass insulation. Product layers 11 are arranged and move in parallel horizontal planes through oven 1. In the case of carbon fiber precursors in tow format, product layers 11 are tows arranged side-by-side in one horizontal layer and rollers or other pass-back devices are used to create one continuous serpentine path through the entire oven.

The product contact air, or process air, is pressurized at fan 3 and passes through in-line heater 4. Fan 3 may be any conventional fan capable of the required flow and pressure drop, and is preferably of a regenerative type. It is preferable that fan 3 draw air from a filtered source or that fresh air is drawn from outside the plant environment. In-line heater 4 may be either electric or fossil-fuel driven, and should be capable of raising the air to the desired process temperature in a single pass of air. Temperature ranges of the process air are preferably between about 100 and 600 degrees Celsius (C), more preferably between about 200 and 400 degrees C. The temperature of the air exiting heater 4 is controlled via a conventional electronic feedback loop using thermometer 6 to measure the temperature and a thyristor or gas flow control valve to modulate the power to heater 4.

The heated air enters manifold 7 and is split into a plurality of paths prior to entering oven 1. Each such gas path through inlet piping 5 includes valve 8 and flow meter 9, which measure and control the flow rate of heated air. Valves 8 may be any conventional control valve designed for the desired temperature range. While not shown on the figure, heater 4, the downstream piping and manifold 7 are thermally insulated, preferably with fiberglass or mineral wool of about 50 mm or greater thickness. Alternative configurations for the process air inlet train may be used. For example, a separate heater could be installed in each gas inlet path 5 downstream of flow control valve 8.

Figure 2:
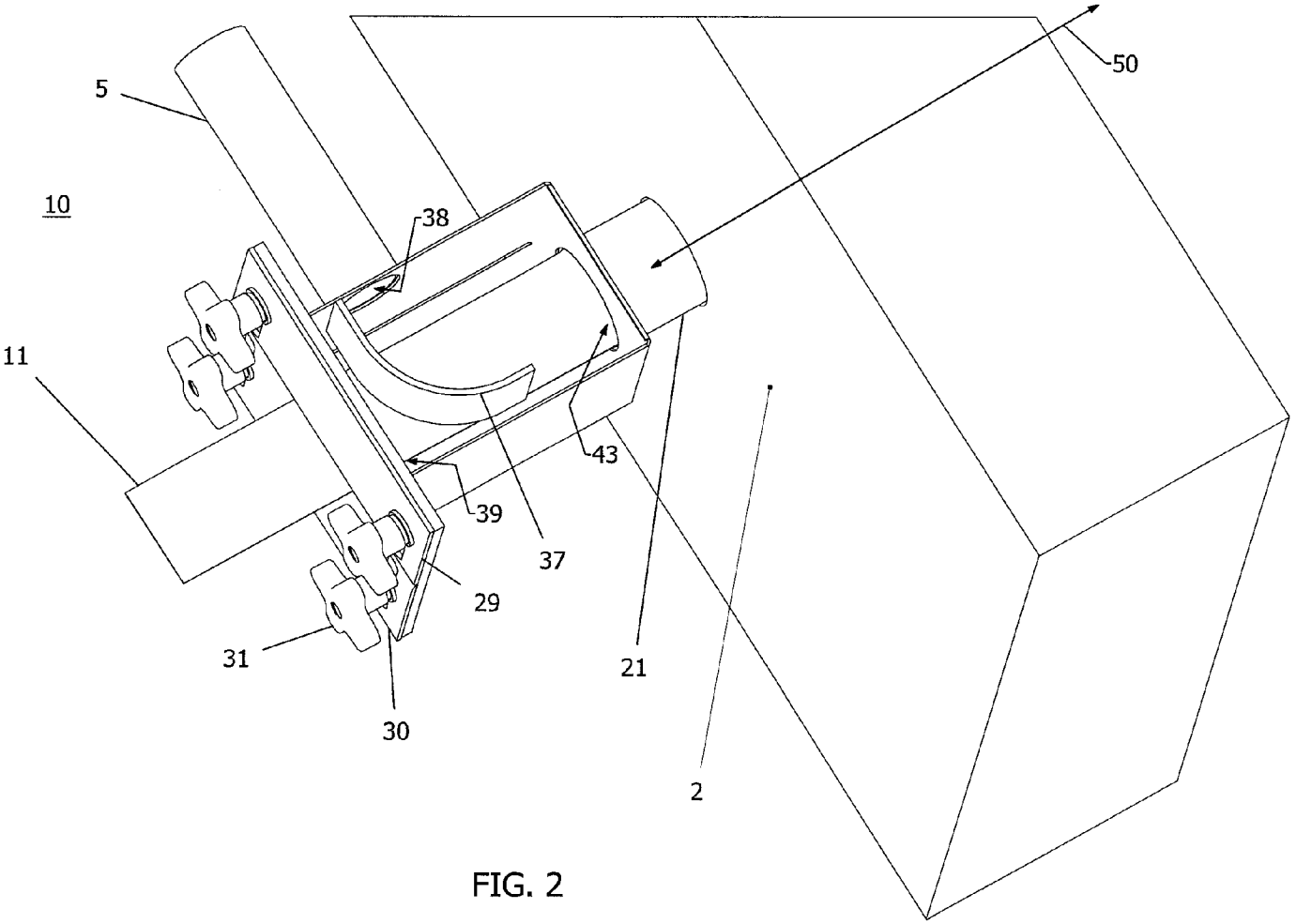
FIG. 2 is an enlarged detailed view of the embodiment shown in FIG. 1, taken within the indicated area A of FIG. 1, with the top sheet metal of the end chamber removed for clarity.

Referring now to FIG. 2, in this embodiment the plurality of process gas inlets are directed via piping 5 through opening 38 in the side wall of end chamber 10, where the gas is then directed by deflector 37 into tubular enclosures 21, which are connected through opening 43 to the back wall of chamber 10 and pass through holes in insulation enclosure 2 and into oven 1. Deflector 37 turns the flow 90 degrees from a lateral direction to a direction normal to the direction of travel of product 11. Air is prevented from flowing out product entrance 39 of chamber 10 by having product entrance 39 of a reduced area. Product opening 39 is defined by an upper product slot plate 29 and a lower product slot plate 30. The size of product slot or opening 39 may be adjusted by sliding the slot plates 29 and 30 vertically, with plates 29 and 30 locked in place or allowed to travel by means of locking screws 31. In PAN oxidation ovens, thickness of product layer 11 varies but is generally about 3 mm or less. The gap 39 between plates 29 and 30 during operation is preferably between about 2 and 20 mm, and more preferably between about 6 and 10 mm. The maximum adjusted gap between plates 29 and 30, for cleaning or other maintenance, is at minimum about equal to the height dimension of product enclosures 21. Other means for fixing the position of plates 29 and 30 may be used. For example, spring loaded bolts may be employed.

Process air enclosures 21 have a relatively small cross section compared to the oven dimensions, and are preferably tubes having a diameter between about 0.01 and 0.40 meters, and more preferable between 0.02 and 0.10 meters. The velocity of the product air flow within enclosures 21 is preferable between about 0.1 and 10 m/sec, and more preferably between about 1 and 6 m/sec. The ratio of the cross-sectional characteristic dimension (diameter in the case of a cylindrical tube) to the length of enclosures 21 is preferable greater than about 10 and more preferably greater than about 50. The high ratio of the cross-sectional characteristic dimension to the length ensures that the flow of air occurs along the direction of travel of product layers 11. While enclosures 21 in the embodiment shown are round tubes, other cross-section tube shapes, such as square, rectangular, elliptical or oval, could be used as an alternative. It should be understood by those skilled in the art that, depending on the cross-sectional moment of inertia and length of enclosures 21, they may require mechanical support along the length of the oven to prevent downward bowing or creeping. These supports can be positioned under enclosures 21 at regular intervals along the oven length and welded or bolted to the inside surface of insulation enclosure 2.

Figure 3:
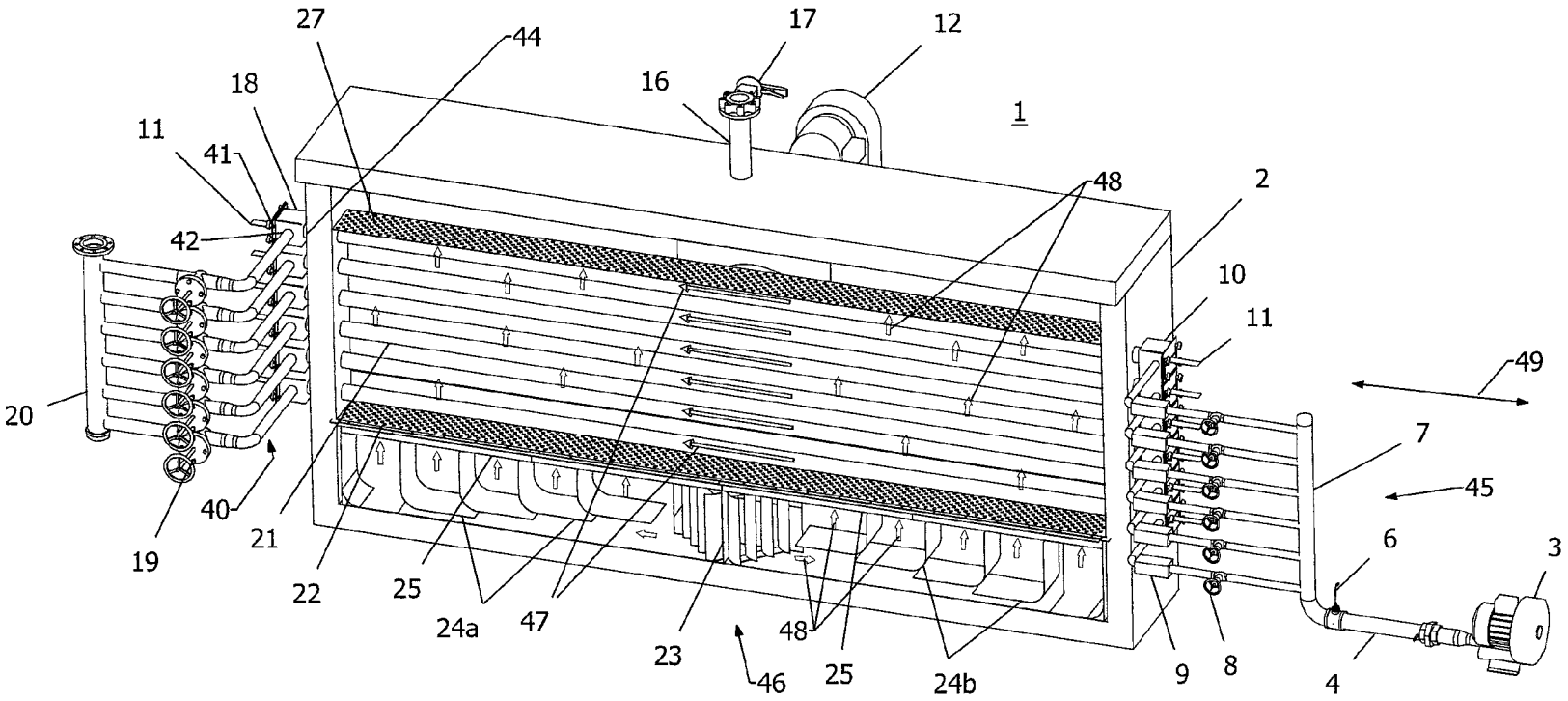
FIG. 3 is a rear perspective view of the embodiment shown in FIG. 1, with one wall of the insulating enclosure removed for clarity.

Referring now to FIG. 3, the plurality of process enclosures 21 and product layers 11 traverse the oven and pass through insulation enclosure 2 and into exit end chamber 18 through opening 44 in chamber 18. Product 11 exits end chamber 18 through a slot 41 between a set of adjustable slot plates similar to plates 29 and 30 described with entrance end chamber 10. The process air flows inside enclosures 21 as shown by arrows 47 and exits in the transverse direction through opening 42 in chamber 18 and a plurality of exhaust piping 40 that includes valve 19. The exhausted air is then collected in exhaust header 20, which is connected to an appropriate air discharge system.

Referring again to FIG. 1, process air travels once through the oven system. It enters at fan 3, and is heated and set to a control flow with heater 4, valve 8 and flow meter 9. Entrance end chamber 10 directs both product 11 and almost all the process air into process enclosures 21, where the air transfers heat and mass with product layers 11. The air and product 11 exit the oven through exit end chamber 18, where the exhaust process air is directed through control valves 19 and into exhaust header 20. The pressure inside of process enclosures 21 is preferably very close to ambient pressure, and most preferably within about 1 mbar and even more preferably within about 0.1 mbar. Valves 8 and 19 and the height of slot openings 39 and 41 in end chambers 10 and 18, respectively, are the means for adjusting this pressure. The near ambient pressure ensures that very little air actually exits or enters process enclosures 21 through the product slots, which means that almost all of the process air, typically about 98% or more, contacts product layers 11. The degree of control can be further increased if exhaust manifold 20 connects to an exhaust handling system with draw or negative pressure. In this case, the oven may be operated such that enclosures 21 have a slight negative pressure, virtually eliminating the escape of process gas at the product slots.

The process air system described has the benefit that the gas contacting the product enters product enclosures 21 free from contaminants and picks up process contaminants only during a single air pass. For example, an oven such as shown in FIG. 1, heat treating 24000 filaments of 1.0 dTex PAN moving at 0.25 m/min, will generate about 1.1 gr/hr of hydrogen-cyanide (HCN) gas. With six oven enclosures 21, each with a 50 mm diameter, and at an air velocity of 4.0 msec and temperature of 250 degrees C., the calculated maximum concentration of HCN in the air stream is about 8 ppm. This compares favorably to HCN concentrations seen inside typical industrial ovens that are between about 40 and 80 ppm.

Referring again to FIG. 1, a secondary air flow is also provided to enclosures 21. Secondary air flow is pressurized by fan 12 and heated by heater 13. Fan 12 may be any conventional fan capable of the required flow, temperature and pressure drop, and is preferably of a plug type configuration. Heater 13 may be either electric or fossil-fuel powered, and should be capable of heating a circulating stream of air to the desired process temperature. The secondary air temperature is controlled via a conventional electronic feedback loop using thermometer 35 to measure the temperature and a thyristor or gas flow control valve to modulate the power of heater 13. The purpose of the secondary air loop is to prevent heat loss or gain to the process air or product layers as they traverse the oven, so the temperature of the secondary air is set and controlled at a temperature substantially the same as the setting of the process air temperature.

Figure 4:
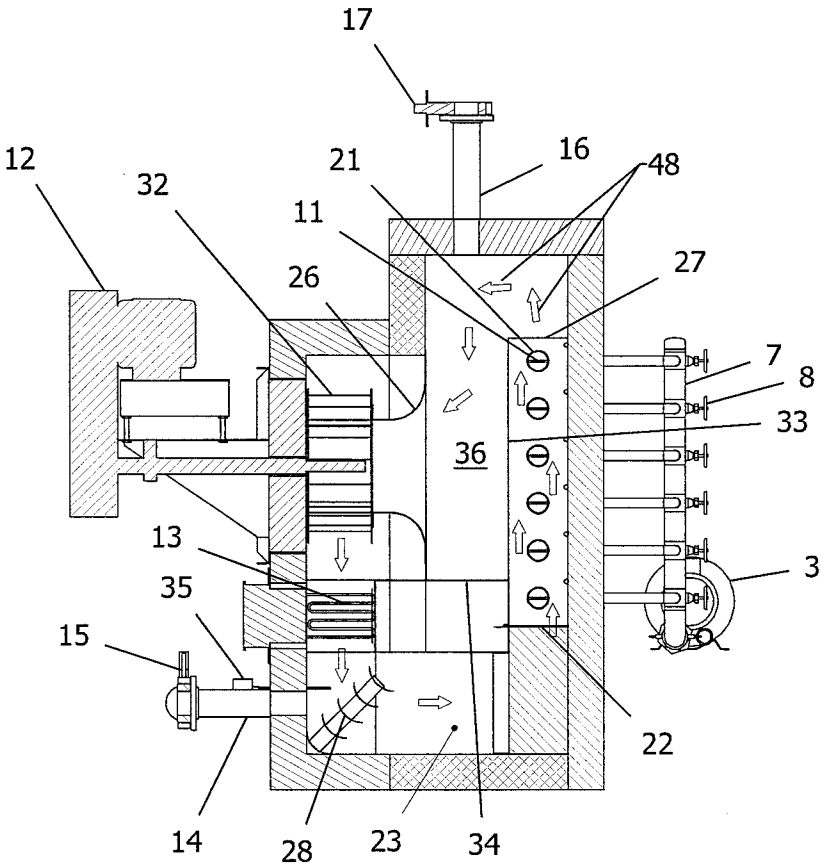
FIG. 4 is a vertical transverse cross-sectional view of the embodiment shown in FIG. 1, taken generally on line B-B of FIG. 1.

Referring to FIGS. 2, 3 and 4, secondary air flows vertically downwards from fan wheel 32 through heater 13. It is turned 90 degrees to flow horizontally and transversally towards the back of oven 1 by a set of turning vanes 28. The secondary airflow is then split in half and redirected horizontally and longitudinally, either toward the entrance or exit end of oven 1 by turning vanes 23. The secondary airflow is then directed upwards vertically by turning vanes 24*a* and 24*b* and enters flow conditioner 25. Flow conditioner 25 is designed to straighten the flow and make the air velocity uniform, and is preferably a device that contains a perforated steel plate and cellular honeycomb structures as described in U.S. patent application Ser. No. 13/180,215, entitled "Airflow Distribution System," the entire disclosure of which is incorporated herein by reference. Flow conditioner 25 includes a second perforated plate 22 on top, through which the air flows at a uniform velocity and uniform vertical direction. The airflow just above plate 22 has velocity characteristics such that the ratio of the standard deviation to the mean is less than about 10%, and more preferably less than about 3%. The direction of flow just above plate 22 is preferably within about 10 degrees of vertical and more preferable within about 3 degrees of vertical. The mean velocity of the vertical flow is preferably between about 1 and 10 m/sec, and more preferably between about 3 and 6 m/sec.

Referring again to FIGS. 2, 3 and 4, the secondary air flows upward over and around process air enclosures 21 and then continues upward through perforated plate 27. The air then enters collection plenum volume 36. Plenum 36 is separated from the airstream that flows upwards over process tubes 21 by vertical wall 33 and is separated from the flow that travels along the oven floor by horizontal wall 34. The recirculating secondary airflow path is shown with arrows 48 in FIGS. 3, 4 and 5. The majority of the secondary airstream re-circulates through fan 12 by entering fan inlet cone 26. A portion of the secondary air is exhausted at secondary oven air exhaust opening 16 and this flow is regulated by secondary air exhaust valve 17. Make-up airflow for the secondary airstream enters the oven at secondary air inlet 14 and is regulated by make-up air valve 15. Since the secondary airstream does not contact the product, it remains essentially clean, and therefore, at steady conditions, very little exhaust or make-up air is required. When it is desired to lower the oven temperature, however, the make-up air flow is useful for introducing cold room air into the oven.

The secondary airstream keeps the temperature of the process air uniform as it flows along the interior length of the process air enclosures 21. For example, if there were no secondary air flow, the temperature of the process air would, depending on velocity, drop by between about 20 to 50 degrees C. between the entrance and exit of the oven, with the largest temperature drops corresponding to the lowest air velocities. With a secondary airflow of about 3 m/sec or greater, the process air temperature change over the length of the oven is less than about 2 degrees C.

The response time to a change in oven desired operation temperature, or setpoint, is determined in practice by the response time of the secondary airstream. This is because the process air consists of a once-through airflow that contacts only product layers 11 and the relatively small air enclosures 21, and so has much lower thermal inertia than the secondary air system. The secondary air contacts the inside of the relatively large insulation enclosure 2 as well as the plug fan wheel 32 and all the other metal components inside the oven. For example, an oven similar to the embodiment shown in FIGS. 1-4 with an insulation enclosure of dimensions of 5.0 m long×2.5 m high×1.0 m wide has a thermal inertial of about 800,000 Joules per degree C. If the oven is operating at a temperature of about 300 degrees C., there will be heat losses through the enclosure and ends of about 10 kW. In this example, heating element 13 with 30 kW of power capacity will thus have 20 kW power available to raise the temperature of the oven, which will result in a time of about 10 minutes to raise the oven temperature by about 15 degrees C. In this example it is assumed that valves 15 and 17 are closed to prevent makeup air from drawing power. Another example, using the same oven parameters just described, would be a lowering of the oven setpoint by about 15 degrees C. In this case, valves 15 and 17 are opened and heater 13 is shut off. In this example, a makeup airflow of about 170 Nm^3/hr (100 scfm) results in about a 15 degree C. drop occurring in about 7 minutes.

A calculation of the maximum temperature rise in product enclosure 21 during an exothermic runaway of PAN precursor will illustrate that the present invention does not require water quenching systems. The conditions assumed are 4×12,000 filament tows of 1.0 dTex at 1 m/min (mass rate of 0.288 kg/hr) in a single 51 mm diameter round enclosure 21, and an air velocity of 1.0 m/sec at 250 degrees C. (mass rate of 6.2 kg/hr). Assuming PAN heat of reaction equals 2425 Joules per gram, and that all the reaction energy is absorbed by the flowing air, the calculated air temperature rise is about 110 degrees C. Thus, even with airflow near the bottom of the typical range, enclosure 21 should not experience a temperature above about 360 degrees C.

While in principle enclosures 21 can be made of many different materials, the preferred materials are austenitic stainless steels such as 304 which maintain mechanical strength until above about 500 degrees C. and can therefore readily withstand this degree of exothermic runaway. The once-through airflow of the present invention promotes removal of the ash or other debris remaining after an exothermic runaway because the airflow itself tends to carry out lighter materials and is constantly being replaced by fresh air. Since the process air stream can be cooled rapidly, for example by about 100 degrees C. in less than about 5 minutes, the end chambers 10 and 18 can be opened within a short time after the exothermic event to facilitate inserting push rods or the like to remove any remaining debris.

Figure 5:
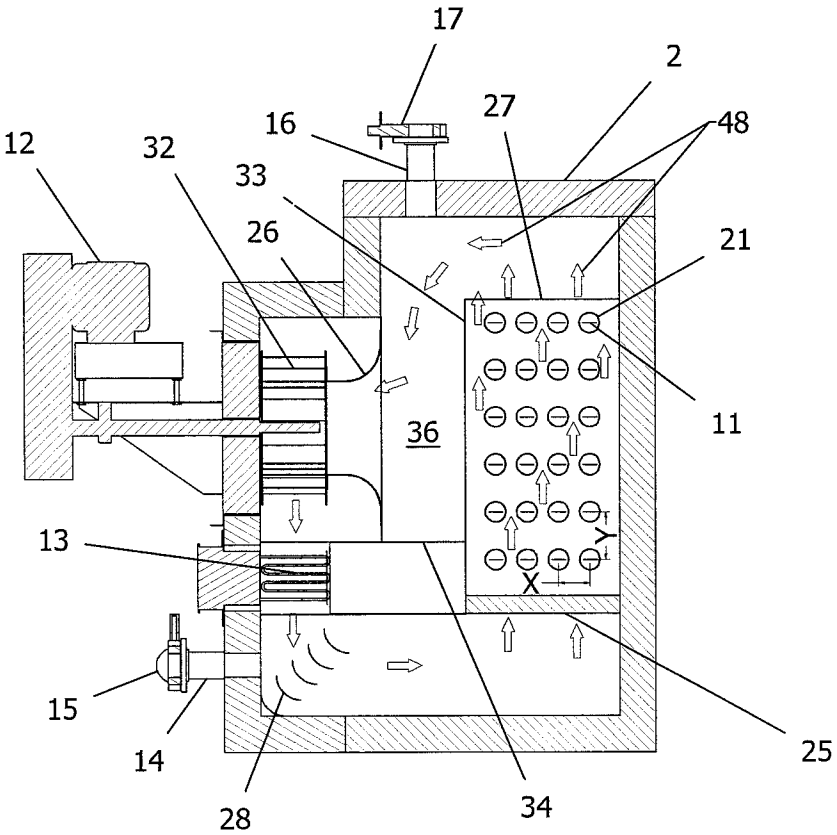
FIG. 5 is a cross-section view of a second embodiment of the oven shown in FIG. 4.

FIG. 5 shows a cross-section of another embodiment of the present invention. In this embodiment, the process air enclosure tubes 21 containing product layers 11 are arranged in multiple vertical rows and columns where the horizontal spacing is delineated by X and the vertical spacing delineated by Y. It is preferable that the ratio of vertical and horizontal spacing, Y/X, of enclosures 21 follows the principles used for conventional tube bundles in heat exchangers. In PAN fiber processing, the vertical spacing Y is established from tow transport considerations outside of the oven, with typical product layer spacing preferably between about 0.1 and 0.4 meters, and more preferably between about 0.15 and 0.20 meters.

The described improvements provide a number of benefits. The oven provides uniform air velocity and consistent contact angle between the air and the fiber product throughout the heated length over a wide range of air velocities. Further, the temperature of the air is uniform for the entire heating length, independent of the velocity. Further, a uniform, steady-state temperature can be achieved rapidly, a benefit because delay in establishment of temperature wastes both time and process material. Further, the process contact air is introduced free of moisture, fiber fly, particulate, and process off-gas chemicals that can degrade the quality of the product. Also, the ability to control the process pressure prevents the escape of process off-gases. In particular, PAN based carbon fiber precursors are known to give off toxic hydrogen cyanide (HCN) which poses an inhalation hazard if allowed to concentrate outside the oven.

Further, for carbon fiber precursors, the oven makes possible handling process upsets in an efficient manner. One type of process upset occurs when precursor tows break inside the oven. The broken tow ends can entangle with other tows, and other passes of tows at different elevations, either right after the break, or later when the broken tow is pulled out of the oven, until the entire process must be stopped and the oven cooled to ambient to allow internal access. With the design of oven 1 a tow break is contained within one minimum cross-sectional area enclosure 21. The tow cannot fall far away from its normal path because of the enclosure, and is therefore unlikely to snag on oven parts or other tows. Oven 1 also facilitates pulling a broken tow out of the oven because the removal path is essentially a straight line and the tow removal point is from the ends outside of the oven and so does not require entering the oven or cooling the oven to ambient temperature.

Another type of process upset occurs when carbon fiber precursor experiences an exothermic runaway reaction resulting in a fire. The oven limits fires from spreading throughout the entire oven volume. In the event of an exothermic process runaway, the heat generated is thus limited. The once-through process air stream carries products of combustion and generated heat out of the oven and there is no need to employ deluge water systems. After an exothermic event or fire, there is no need to stop the secondary air flow, no need to cool the oven to ambient temperature, and no need to enter the oven. Further, the oven limits fires from spreading without resorting to deluge water systems that are expensive to install and maintain, and which, when activated, require a time consuming cleanup inside an ambient temperature oven before the process can be restarted. This means the overall process upset due to an exothermic runaway or fire can be a matter of minutes, as compared to hours with conventional carbon fiber precursor ovens.

The design of oven 1 provides uniform air velocity and consistent contact angle, temperature uniformity, short temperature response time, clean process gas, reduces or eliminates the need for post process treatment of the off gas, and makes possible efficient handling of process upsets. The fiber passes through the oven within enclosure 21 that are essentially the minimum possible cross-sectional area considering fiber catenary and natural vibrations. This small cross-section means that the ratio of the process enclosure length to its cross-sectional characteristic dimension is very large, creating boundary conditions that ensure the airflow is nearly exactly parallel to the fiber. The small cross-section area has the additional advantage that, for a given air velocity, the required amount of process air is kept to a minimum, thereby requiring minimum energy for pressurization and heating.

The air passed through these product enclosures is filtered, pressurized, heated to the desired process temperature, and flow modulated upstream, flows parallel to the fiber through the enclosure, and exits to an exhaust system. Air only touches each element of the system one time. This means that the process air does not accumulate moisture, fiber fly, particulate, or other process off-gas chemicals that can degrade the quality of the product. Because there is no concentrating of process volatiles, the exhausted process air from PAN carbon fiber precursor does not necessarily require expensive incineration or other means of post treatment to destroy HCN.

The once-through heating process is very fast thermally and thus the temperature of the process air can be changed rapidly, for example by 100 degrees C. in less than 5 minutes. This substantially reduces lost time and facilitates operator safety during tow removal. Tow removal can be done without changing the secondary air flow or temperature, so that once the broken tow is removed, the process air flow and temperature can be rapidly reestablished. This means the overall process upset due to a tow break can be a matter of minutes, as compared to hours with conventional carbon fiber precursor ovens. A benefit of the secondary air flow outside the process enclosures, and therefore not in contact with the fiber, is that it maintains a high degree of temperature uniformity within oven 1. This re-circulated air flow is pressurized and heated to the desired process temperature with a dedicated fan and heater located integral to the oven casing. This air flows over and around the process air enclosures, keeping the outside surface at the desired process temperature, and thus preventing heat loss from the process air flowing parallel to the fiber. This affect provides temperature uniformity of the process contact air even at very low process air velocities, which is inherently difficult since in that case small heat loss or gain will tend to produce large temperature differences. The secondary air flow is provided with a modulated supply of cold fresh air. The secondary air temperature can be raised with increased heating power or lowered by increasing the intake of cold fresh air. This means that the secondary air temperature can be brought to equilibrium quickly whether the temperature change is an increase or a decrease.

The present invention contemplates that many changes and modifications may be made. Therefore, while the presently-preferred form of the oven for fiber heat treatment has been shown and described, and several modifications and alternatives discussed, persons skilled in this art will readily appreciate that various additional changes and modifications may be made without departing from the spirit and scope of the invention, as defined and differentiated by the following claims.

The invention claimed is:

1. An oven comprising:

a conveyor configured and arranged to move a product to be processed through an oven;

a primary air delivery system having a primary fan and a primary heater and configured and arranged to provide a heated primary air flow;

a secondary air delivery system having a secondary fan and a secondary heater and configured and arranged to provide a heated secondary air flow;

a processing enclosure configured and arranged to receive and contain said product and said primary air flow;

an insulated enclosure configured and arranged to receive said heated secondary air flow;

said processing enclosure configured and arranged to extend through said insulated enclosure and said heated secondary air flow and to separate said primary air flow from said secondary air flow.

2. The oven set forth in claim 1, wherein:

said conveyor is configured to move said product through said processing enclosure in a first direction;

said processing enclosure has a longitudinal enclosure axis substantially parallel to said first direction;

said primary air flow in said processing enclosure is substantially parallel to said first direction; and said secondary air flow in said insulated enclosure proximal to said processing enclosure is substantially perpendicular to said first direction.

3. The oven set forth in claim 2, wherein said secondary air delivery system comprises:

said secondary fan having a plug fan with an axis perpendicular to said processing enclosure axis, located on an insulation enclosure wall approximately midway along a product travel dimension of said oven, said secondary fan having an upstream inlet cone for receiving air and a discharge plenum that directs flow downwards;

said secondary heater positioned downstream and near said fan discharge port;

a thermometer positioned downstream and near said secondary heater;

a set of directing vanes positioned near said secondary heater and near a floor of said insulated enclosure that turn said flow 90 degrees to flow adjacent to said floor of said insulated enclosure;

a second set of vanes that split said flow approximately in half and turn a first half portion of said flow 90 degrees to be aligned with said first direction and turn said second half portion of said flow 90 degrees to be opposite said first direction;

a third set of vanes that turn said first portion of said flow 90 degrees to flow upwards in a direction perpendicular to said enclosure axis;

a fourth set of vanes that turn said second portion of said flow 90 degrees to flow upwards in a direction perpendicular to said enclosure axis;

a flow conditioning device that spans a length of said oven and is wider than a widest dimension of the processing enclosure and through which said upward air flow passes before contacting said processing enclosure;

an upper perforated plate above said processing enclosure; and an air collection plenum separating air that flows through said upper perforated plate and into said secondary fan inlet cone from air that is discharged from said secondary fan and flows through said heater, turning vanes, flow conditioner and over said processing enclosure.

4. The oven set forth in claim 3, wherein said flow conditioning device comprises two perforated plates with a cellular structures located there between.

5. The oven set forth in claim 4, wherein said cellular structure is a honeycomb structure.

6. The oven set forth in claim 1, wherein said primary air delivery system comprises an input chamber configured and arranged to receive said primary air flow and said conveyed product and to output said primary air flow and said conveyed product to said processing enclosure.

7. The oven set forth in claim 6, wherein said conveyor is configured and arranged to move said product through said processing enclosure in a first direction and said chamber outputs said heated primary air flow and said conveyed product to said processing enclosure in said first direction.

8. The oven set forth in claim 7, wherein said input chamber comprises:

an air input opening;

a product input opening different from said air input opening;

an output opening to said processing enclosure opposite said product input opening; and an airflow directional configured and arranged to direct airflow from said air input opening to said output opening.

9. The oven set forth in claim 8, wherein said air input opening is orientated substantially perpendicular to said output opening and said airflow directional is configured and arranged to turn said airflow from a direction substantially perpendicular to said first direction to a direction substantially parallel to said first direction.

10. The oven set forth in claim 8, wherein said chamber further comprises a product input opening size adjustment mechanism.

11. The oven set forth in claim 10, wherein said opening size adjustment mechanism comprises a first plate and a second plate, said first and second plates adjustable relative to each other so as to provide a variable gap there between.

12. The oven set forth in claim 11, and further comprising a locking mechanism configured and arranged to adjustably lock said plates in a position relative to said chamber so as to vary said size of said product opening.

13. The oven set forth in claim 12, wherein said locking mechanism comprises locking screws.

14. The oven set forth in claim 6, wherein said input chamber comprises:

an air input opening;

a product input opening different from said air input opening and having a product opening size;

an output opening to said processing enclosure having an output opening size;

wherein said output opening size is greater than said product opening size.

15. The oven set forth in claim 1, wherein said primary air delivery system comprises one or more devices selected from a group consisting of a thermometer, a manifolds, a valve, a flow meter and a pipe.

16. The oven set forth in claim 1, wherein said primary air delivery system comprises:

a thermometer;

a single manifold configured and arranged to split airflow into a plurality of downstream paths, each of said paths comprising a valve and a flow meter; and wherein said primary air flow is generated and circulated through said primary heater, said manifold and said valve no more than once before being brought into contact with said product.

17. The oven set forth in claim 1, wherein said primary air delivery system comprises a manifold configured and arranged to split airflow into a plurality of downstream paths, each of said paths comprising a valve, a flow meter, an in-line heater and a thermometer, before being brought into contact with said product.

18. The oven set forth in claim 1, wherein said primary air delivery system does not re-circulate, in whole or in part, primary air flow exiting said processing enclosure.

19. The oven set forth in claim 1, wherein said secondary air delivery system comprises:

a thermometer;

a recirculating inlet for receiving used air from said insulated enclosure;

an air exhaust outlet having a flow control valve for exhausting air from said insulated enclosure; and a make-up air inlet having a flow control valve for receiving make-up air;

wherein said secondary air flow may comprise a mix of said used air and said make-up air.

20. The oven set forth in claim 19, wherein make-up air flow and exhaust air flow may be controlled by said valves to vary said amount of said make-up air and said used air in said secondary air flow.

21. The oven set forth in claim 1, wherein said primary air delivery system and said secondary air delivery system are configured and arranged to deliver said primary air flow inside said processing enclosure and to deliver said secondary air flow outside said processing enclosure at a temperature range that is about the same.

22. The oven set forth in claim 1, wherein said processing enclosure has a length and a cross-sectional characteristic dimension and said length is at least about fifty times said cross-sectional characteristic dimension.

23. The oven set forth in claim 1, wherein processing enclosure has a cross-sectional shape that is circular, square, rectangular, oval or elliptical.

24. The oven set forth in claim 1, and comprising multiple processing enclosures configured and arranged to receive and contain said product and said primary air flow and extending through said insulated enclosure.

25. An oven comprising:

a conveyor configured and arranged to move a product to be processed through an oven;

a primary air delivery system configured and arranged to provide a heated primary air flow;

a secondary air delivery system configured and arranged to provide a heated secondary air flow;

a processing enclosure configured and arranged to receive and contain said product and said primary air flow;

an insulated enclosure configured and arranged to receive said heated secondary air flow;

said processing enclosure configured and arranged to extend through said insulated enclosure and said heated secondary air flow and to separate said primary air flow from said secondary air flow; and an output chamber configured and arranged to receive said product and said primary air flow from said enclosure and to exhaust said primary air flow and discharge said product from said oven.

26. The oven set forth in claim 25, wherein said output chamber comprises:

an input opening from said processing enclosure;

a product discharge opening opposite said input opening; and an air exhaust opening different from said product discharge opening.

27. The oven set forth in claim 26, wherein said air exhaust opening is orientated substantially perpendicular to said input opening.

28. The oven set forth in claim 26, wherein said output chamber further comprises a product input opening size adjustment mechanism.

29. The oven set forth in claim 28, wherein said opening size adjustment mechanism comprises a first plate and a second plate, said first and second plates adjustable relative to each other so as to provide a variable gap there between.

30. The oven set forth in claim 29, and further comprising a locking mechanism configured and arranged to adjustably lock said plates in a position relative to said chamber so as to vary said size of said product discharge opening.

31. The oven set forth in claim 30, where said locking mechanism comprises locking screws.

32. An oven comprising:

a conveyor configured and arranged to move a product to be processed through an oven;

a primary air delivery system configured and arranged to provide a heated primary air flow;

a secondary air delivery system configured and arranged to provide a heated secondary air flow;

multiple processing enclosures configured and arranged to receive and contain said product and said primary air flow;

an insulated enclosure configured and arranged to receive said heated secondary air flow;

each of said multiple processing enclosure configured and arranged to extend through said insulated enclosure and said heated secondary air flow and to separate said primary air flow from said secondary air flow; and multiple input chambers and multiple output chambers communicating with said respective multiple processing enclosures.

* * * * *